United States Patent [19]

Tsuchida et al.

[11] Patent Number: 5,075,922

[45] Date of Patent: Dec. 31, 1991

[54] VACUUM CLEANER

[75] Inventors: Yasuyuki Tsuchida, Hyogo; Yuji Nakanishi, Kasai, both of Japan

[73] Assignee: Sanyo Electric Co., Ltd., Osaka, Japan

[21] Appl. No.: 451,411

[22] Filed: Dec. 15, 1989

[30] Foreign Application Priority Data

Dec. 28, 1988 [JP] Japan ..... 63-331051
Jan. 9, 1989 [JP] Japan ..... 1-2383

[51] Int. Cl.[5] ..... A47L 7/00
[52] U.S. Cl. ..... 15/339; 15/257 B
[58] Field of Search ..... 15/339, 412, 257 B, 15/300 R; 422/307

[56] References Cited

U.S. PATENT DOCUMENTS

| | | | |
|---|---|---|---|
| 4,108,143 | 8/1978 | Pelsue et al. | 126/110 B |
| 4,654,924 | 4/1987 | Getz et al. | 15/339 |
| 4,731,898 | 3/1988 | Sovis et al. | 15/339 |
| 4,733,431 | 3/1988 | Martin | 15/339 |
| 4,852,208 | 8/1989 | Morishita et al. | 15/339 |

FOREIGN PATENT DOCUMENTS

| | | | |
|---|---|---|---|
| 3740517 | 6/1989 | Fed. Rep. of Germany | 15/257 B |
| 2540719 | 8/1984 | France | 15/257 B |
| 127026 | 6/1987 | Japan . | |

*Primary Examiner*—Henry J. Recla
*Assistant Examiner*—Glenn T. Barrett
*Attorney, Agent, or Firm*—Darby & Darby

[57] ABSTRACT

A vacuum cleaner for killing noxious small organisms trapped in a dust chamber of the cleaner body by circulating heated exhaust of an electric air blower through the dust chamber, the cleaner having a temperature sensing element for sensing a temperature in the dust chamber, a timer for timing a specified interval from a point of time when the electric air blower is started to kill the noxious small organisms with heat, and a microcomputer for stopping the supply of electric power to the electric air blower when a temperature sensed by the temperature sensing element reaches a temperature fatal to the noxious small organisms or when the timer has timed the specified interval with the sensed temperature being lower than the predetermined temperature.

8 Claims, 8 Drawing Sheets

VACUUM CLEANER

BACKGROUND OF THE INVENTION (1) Field of the Invention

The present invention relates to a vacuum cleaner, and more particularly, to a vacuum cleaner having means of killing noxious small organisms, such as mites, caught in the dust chamber of the cleaner body.

(2) Description of the Prior Art

Japanese Unexamined Patent Publication No. 127026/1987 discloses a vacuum cleaner in which air heated by an electric air blower in a body of the vacuum cleaner circulates through a dust chamber so that noxious small organisms, such as mites, caught in the dust chamber and are killed by heat. In this prior art embodiment, a delay timer switch or a bimetal switch is used as switching means for stopping mite killing operation. However, such vacuum cleaner has disadvantages as follows: In the vacuum cleaner employing the delay timer switch as the switching means, the mite killing operation is carried out independent of a temperature heating the dust chamber, and the electric air blower never stops until a preset time even when a temperature of the electric air blower itself rises because of a rise in the temperature in the ambient air, for example, in summer. On the other hand, in the vacuum cleaner employing the bimetal switch, the electric air blower never stops to continue the mite killing operation until a temperature in the heated dust chamber reaches a temperature preset at the bimetal switch, if the temperature in the ambient air falls, for example, in winter.

SUMMARY OF THE INVENTION

The present invention provides a vacuum cleaner having means of killing noxious small organisms in a dust chamber with heat. The vacuum cleaner assures safety by automatically stopping an electric air blower when a temperature in the heated dust chamber reaches a predetermined temperature or when the operation of killing the noxious small organisms with heat has been carried out for a predetermined period of time.

The vacuum cleaner comprises means for killing noxious small organisms trapped in a dust chamber of the cleaner body by circulating the heated exhaust of an electric air blower through the dust chamber, which provides storage means for storing a predetermined temperature corresponding to a temperature fatal to noxious small organisms; sensing means for sensing a temperature of the heated exhaust; judging means for judging if a temperature sensed by the sensing means reaches the predetermined temperature and for outputting a signal when the sensed temperature reaches the predetermined temperature; timer means for timing a specified interval from a point of time when the electric air blower is started and for outputting a signal when a timed period corresponds to the specified interval; and protection means receiving a signal outputted from the judging means or a signal outputted from the timer means, for stopping supplying electric power to the electric air blower to protect the electric air blower. A microcomputer serves as the storage means, judging means, timer means and protection means.

Preferably, the vacuum cleaner according to the present invention provides the dust chamber having an air inlet, a fan chamber for accommodating the electric air blower in which the fan chamber is communicated with the dust chamber at the side opposite to its air inlet and provides an air outlet and a position between the electric air blower and the air outlet in the fan chamber is further communicated with the dust chamber through an air channel, and control means for driving the electric air blower so that heated exhaust of the electric air blower circulates along the air channel through the dust chamber.

In accordance with the present invention, in cleaning operation the noxious small organisms such as mites are trapped together with dust in the dust chamber, and in mite killing operation heated exhaust of the electric air blower circulates through the dust chamber, the sensing means senses the temperature of the heated exhaust, and the microcomputer stops to supply electric power to the electric air blower when the temperature of the heated exhaust reaches a temperature fatal to the noxious small organisms. Thus the mite killing operation ends. When the temperature of the heated exhaust does not reach the temperature fatal to the noxious small organisms because of the low temperature in the ambient air, power supply to the electric air blower is stopped to cease the mite killing operation after the timer means times the mite killing operation by a specified interval.

The present invention may further comprise second storage means for storing an unusual temperature representing a disorder of the above mentioned sensing means, second judging means for outputting a signal when a temperature sensed by the above mentioned sensing means is the unusual temperature and informing means receiving a signal outputted from the second judging means, for informing a user of a disorder of the above mentioned sensing means, so that the user can know the disorder of the above mentioned sensing means due to the breaking of a wire or a short-circuit. The informing means may be a light emitting diode and/or a buzzer.

The present invention may still further comprise indicating means having a plurality of indicators whose indication state varies in accordance with the temperature sensed by the above mentioned sensing means, so that the user can know a progress of killing of the noxious small organisms from the indication. The indicating means preferably comprises, for example, first and second indicators for indicating living and dead states of the noxious small organisms and an indication control circuit for controlling the first and second indicators so that the first indicator lights up at the beginning of killing the noxious small organisms, the first and second indicators alternately light up and out in killing the noxious small organisms and the second mite indicator lights up when the temperature in the dust chamber reaches a temperature fatal to the noxious small organisms.

BRIEF DESCRIPTION OF THE DRAWINGS

An embodiment of the invention will now be described by way of example and with reference to the accompanying drawings, in which:

FIG. 1 is a sectional view of the embodiment;

FIG. 2 is a plan view of the embodiment;

FIG. 3 is an enlarged plan view of a function indication unit of FIG. 2;

FIG. 4 is an electric circuit diagram of the embodiment;

FIG. 5 is a block diagram showing a circuit architecture of the embodiment; and

FIGS. 6(*a*) to 6(*c*) are flow charts presented for explaining an operation of the embodiment.

DETAILED DESCRIPTION OF PREFERRED EMBODIMENT

Figure 1:
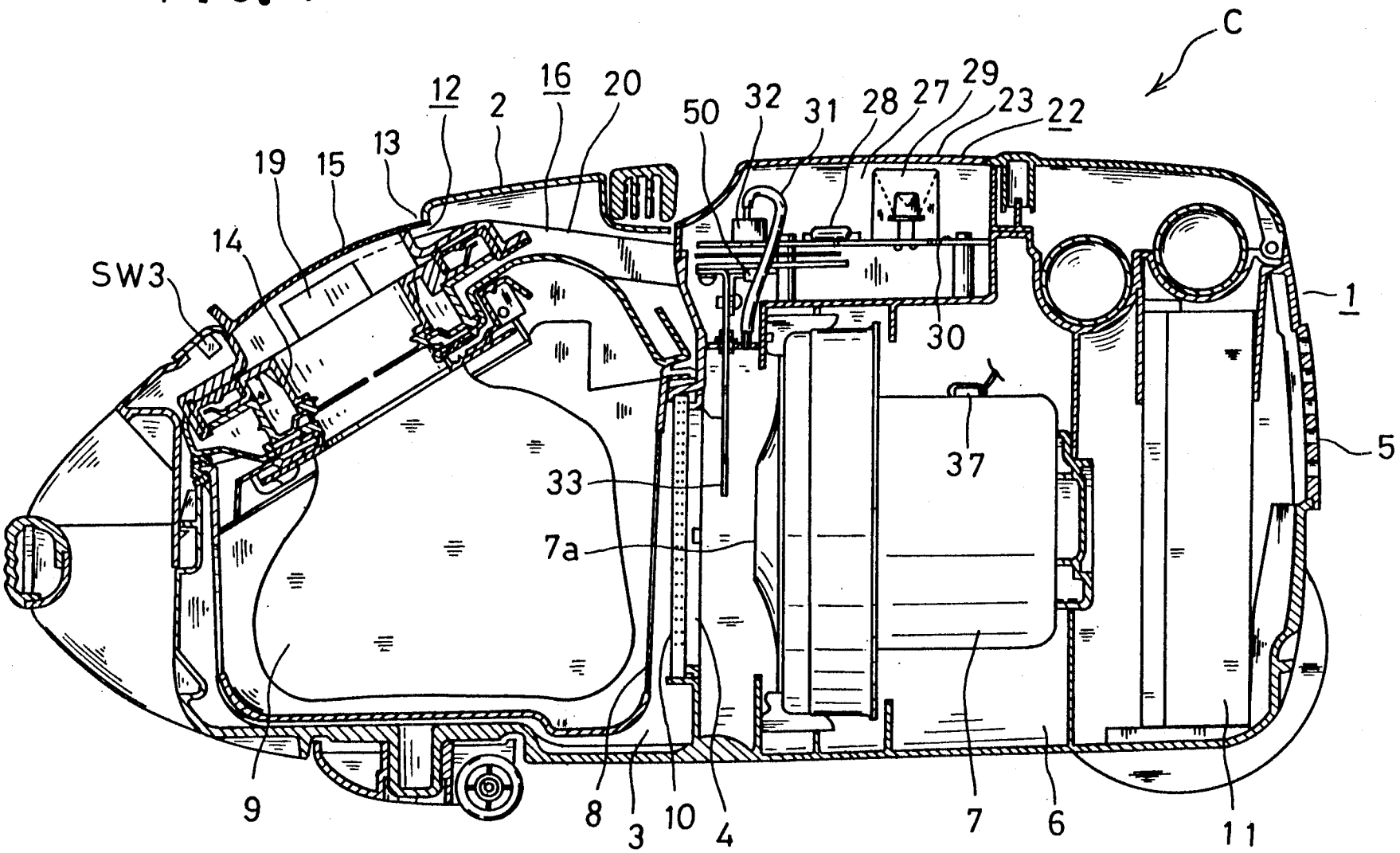
FIGS. 1 to 6 are related to the preferred embodiment of a vacuum cleaner according to the present invention.
Figure 2:
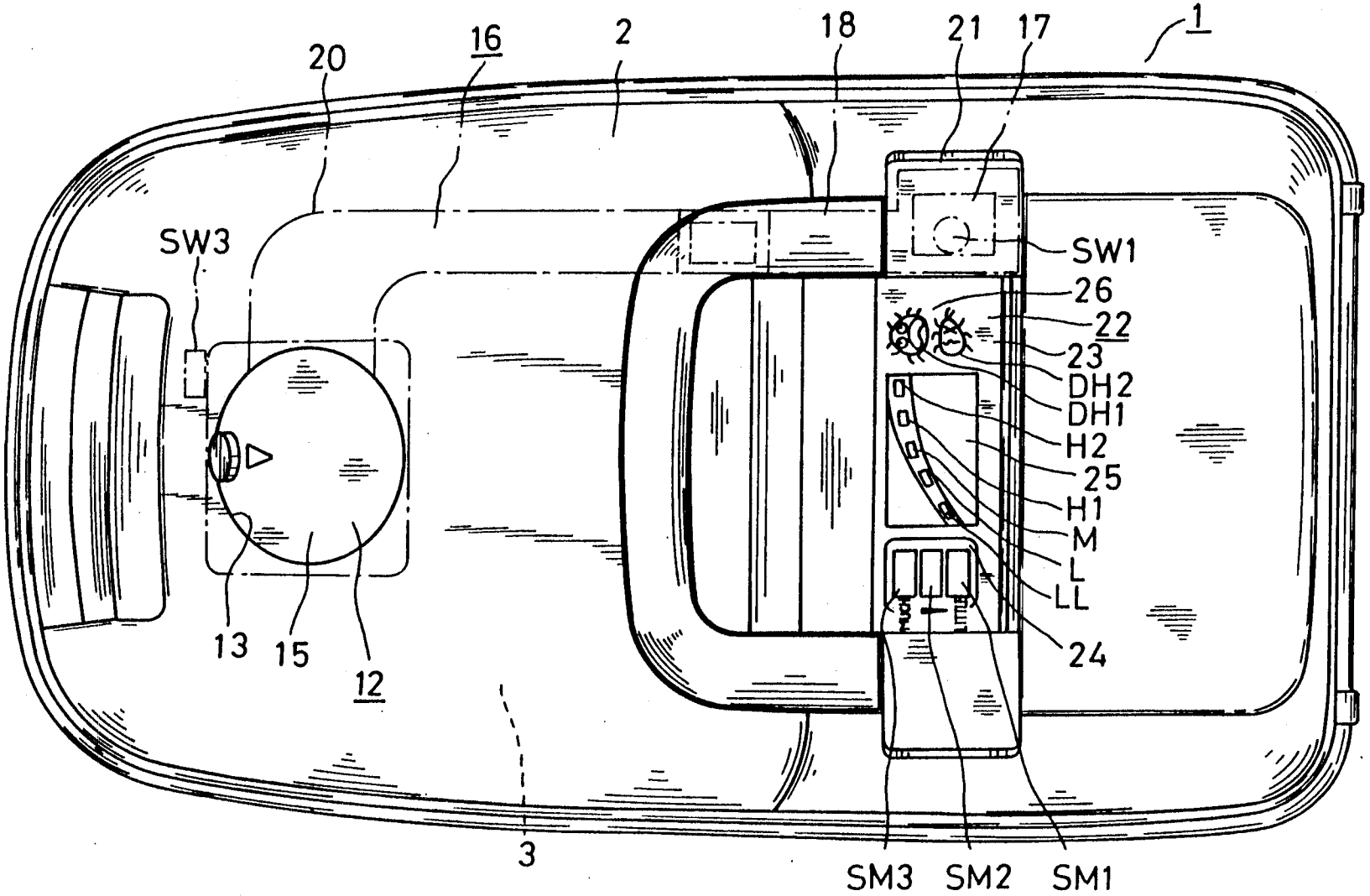
Figure 3:
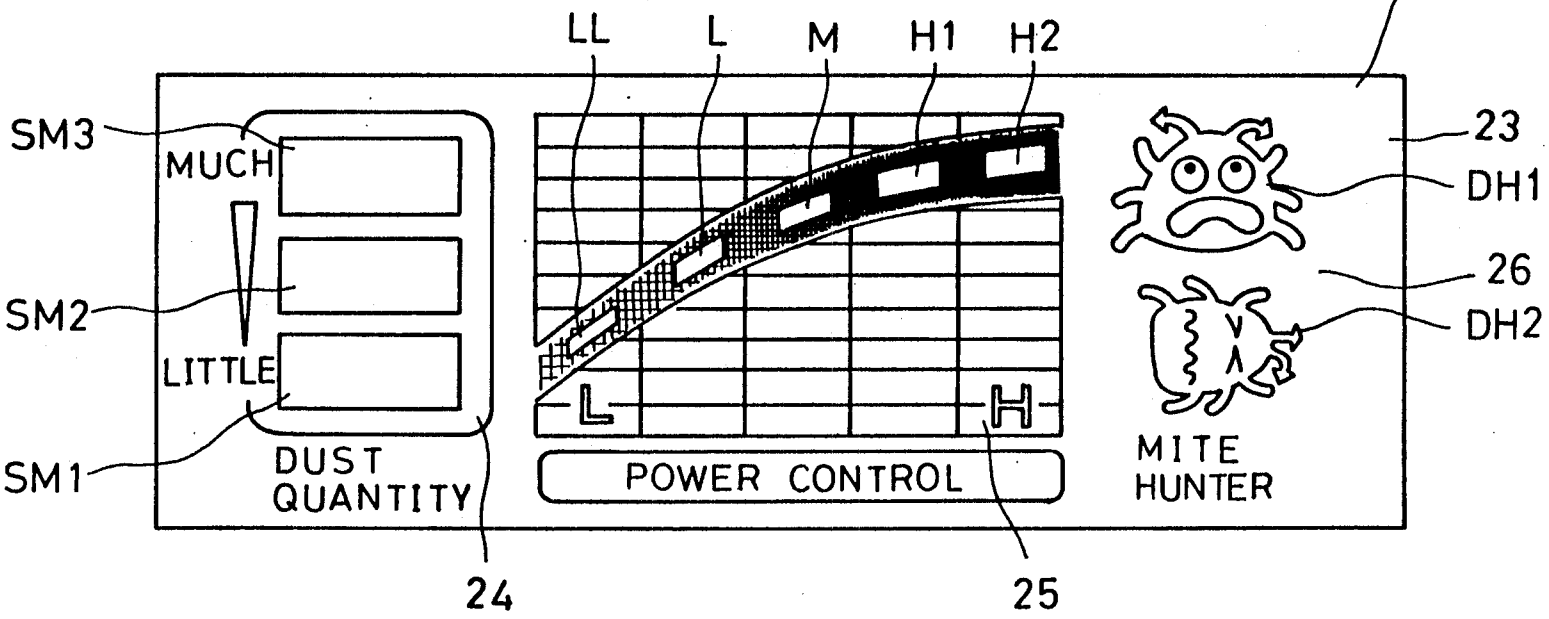

Referring to FIGS. 1 to 3, a vacuum cleaner C comprises a cleaner body 1, a dust chamber 3 provided in the front part of the body 1 and an air blower chamber 6 in the rear part of the body 1. The dust chamber 3 has an upper aperture covered with a cover 2, and the air blower chamber 6 communicates with the dust chamber through a vent 4 and is provided with an exhaust port 5 in its rear wall.

The electric air blower 7 is housed in the air blower chamber 6 and hermetically communicates in its suction side with the dust chamber 3. A basket-shaped filter 8 has air permeability, and is removably housed in the dust chamber 3. A filter 9 is formed of a paper bag having air permeability but not permitting passage of small noxious organisms such as mites therethrough, and is removably housed in the basket-shaped filter 8. The basket-shaped filter 8 and the paper bag filter 9 cooperatively serves as a dust-collecting filter. Also, an air suction filter 10 and an air discharge filter 11 are mounted in the cleaner body 1.

The cover 2 is formed with an air inlet portion 12 and a suction hose is removably connected thereto. The air inlet portion 12 has an air inlet 13, and comprises a hose socket 14 and a plate 15 positioned above the hose socket 14 and serving as a slidably opening and closing shutter for the air inlet 13.

The cleaner body 1 is further provided with an air channel 16 along which exhaust of the electric air blower 7 circulates through the dust chamber 3 to heat up the dust chamber 3 to a temperature high enough to kill the small noxious organisms such as mites caught in the filter 9. The air channel 16 consists of the first air channel 18 (at the body's side) and the second air channel 20 (at the cover's side). The first air channel 18 has its air inlet at the air blower chamber 6 while the second air channel 20 has its air outlet 19 at the hose socket 14 of the air inlet portion 12. When the suction hose is attached to the suction opening portion 12 in the cleaning operation, the air outlet 19 is closed not to pass the exhaust of the air blower 7, and when the suction hose is detached in the mite killing operation, it conducts the exhaust to the dust chamber 3.

A mite killing switch button (hereinafter called as mite killing button) 21, which is of push-button type, is provided on the right in the center portion of the upper face of the cleaner body 1. A mite killing operation switch (hereinafter called as mite killing switch) SW1, which is a tactile switch, is inside the mite killing switch button 21 to turn on by depressing the mite killing button 21.

A shutter switch SW3 is provided in the air inlet portion 12. The shutter switch SW3 is turned off by the shutter plate 15 coming in contact with it when the shutter plate 15 is closed, and turned on when the shutter plate 15 is opened.

A function indication unit 22 as display means is provided in the center portion of the upper face of the cleaner body 1. In the function indication unit 22, light emitting diodes illuminates a display panel 23 from its back. Namely, each function indicator shines by lighting up each of the light emitting diodes. The indication unit 22 as shown in FIG. 3, consists of a dust meter 24, a power control indicator 25 and a mite killing indicator 26. The dust meter 24 indicates five levels of dust volume in the filter 9 with illumination of three light emitting diodes (LEDs), D1 to D3. The dust volume can be recognized at sight by illumination of a green indicator SM1 corresponding to the light emitting diode D1, an orange indicator SM2 corresponding to the light emitting diode D2 and a red indicator SM3 corresponding t the light emitting diode D3 in the order of dust volume, small to large. When the filter 9 should be replaced with a new one, the green, orange and red indicators light up and out to let a user to know that. Specifically, the five levels of dust volume are indicated by putting the lights out entirely, lighting up one light emitting diode (D1), lighting up two light emitting diodes (D1 and D2), lighting up three light emitting diodes (D1, D2 and D3) and sequentially lighting up and extinguishing the three light emitting diodes (D1, D2 and D3), in the order of dust volume, small to large. The power control indicator 25 indicates a suction force of the electric air blower 7, namely, a state of output control, with a level indicator of the five levels, LL, L, M, H1 and H2, corresponding to five red light emitting diodes D4 to D8, respectively.

The mite killing indicator 26 indicates progress of a mite killing operation by illuminating first and second mite indicators DH1 and DH2 with a green light emitting diode D9 and a red light emitting diode D10, so that a state of the mite killing operation can be known with an impressive visual representation with the lapse of time. Lighting up in the first mite indicator DH1 represents mites are alive, and lighting up in the second mite indicator DH2 that the mites are killed. The mite killing indicator 26 shows an effect of the mite killing operation by variations of lighting up the first mite indicator DH1, alternately lighting up and extinguishing the first and second mite indicators DH1 and DH2 and lighting up the second mite indicator DH2 in accordance with a temperature increase within the dust chamber 3 and with the lapse of time during the mite killing operation. Thus, the effect of the mite killing operation becomes apparent with the variations in the visual representation. Those representations of the dust meter 24, power control indicator 25 and mite killing indicator 26 are controlled by a display control circuit of a microcomputer, which is mentioned hereinafter.

A control plate chamber unit 27 is formed in the upper portion of the air blower chamber 6 in the cleaner body 1. The control panel chamber unit 27 is covered with the panel 23 at its top face and accommodates a control circuit panel 30 provided with a control circuit element 28, the light emitting diodes D1 to D10 and a reflection member 29 at the bottom part. Further, a semiconductor pressure sensor 32 and an air blower control bidirectional triode thyristor 50 are attached to the control circuit panel 30. The semiconductor pressure sensor 32 communicates with the outlet of the suction unit 7*a* of the electric air blower 7 through a tube 31, for determining a pressure at the suction outlet 7*a*. The air blower control bidirectional triode thyristor has a radiation plate 33 positioned in the space at the suction unit 7*a*. For the sensor 32, a diffusion type semiconductor pressure sensor (e.g., a FPN-07PGR type semiconductor pressure sensor manufactured by FUJIKURA Ltd.) which operates on a piezoresistance effect is used.

Figure 4:
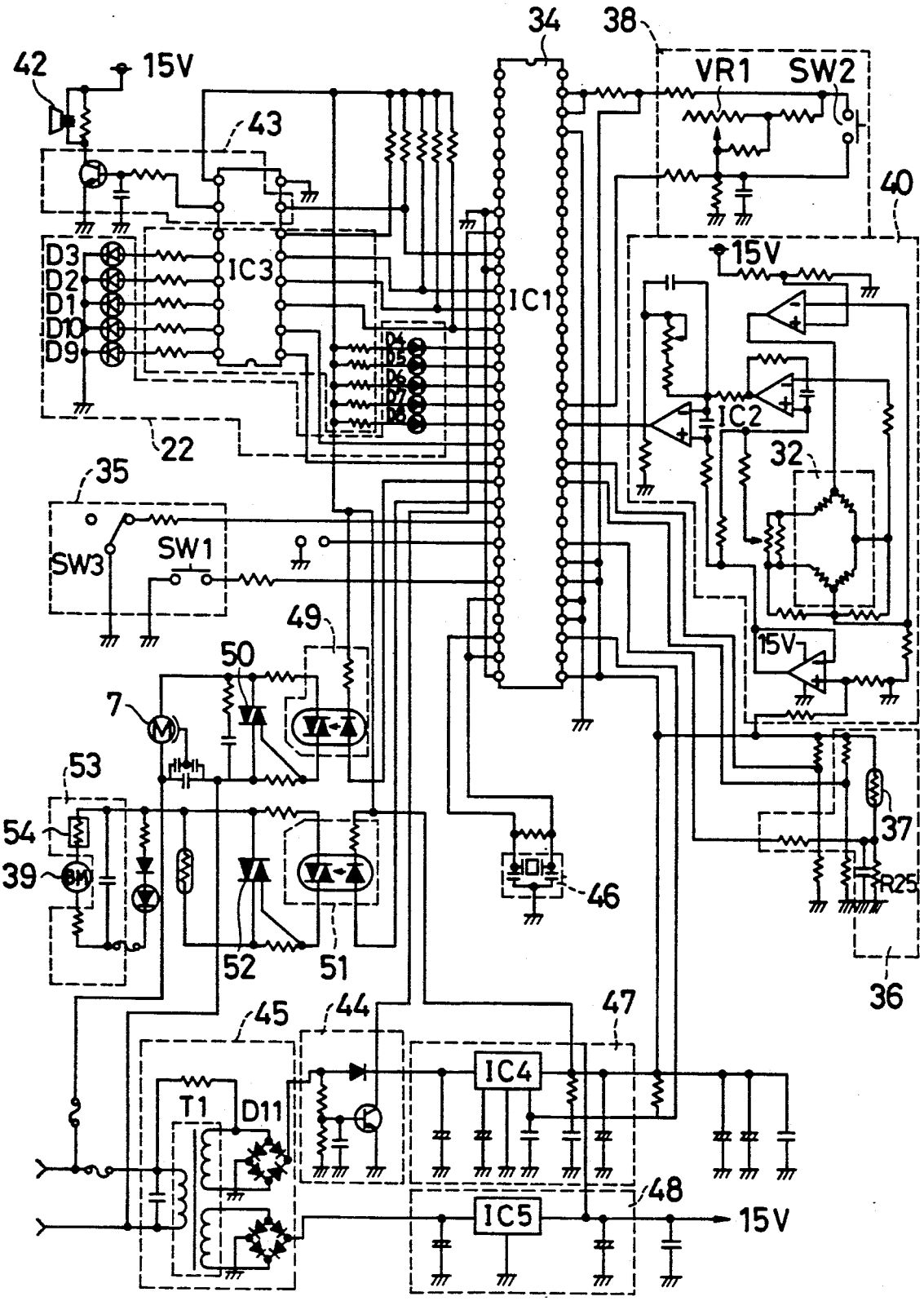
Figure 5:
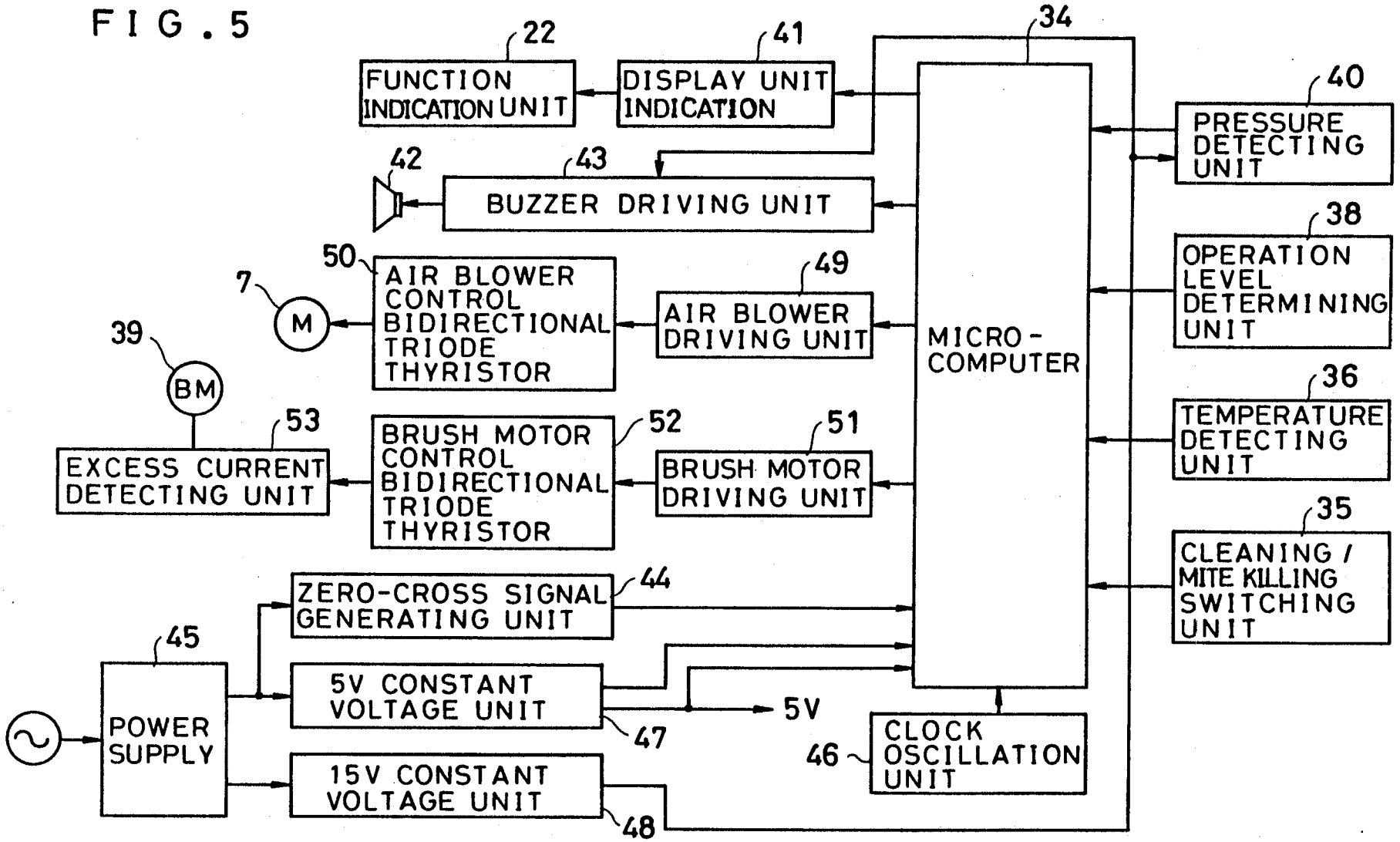

Referring to an electric circuit in FIG. 4 and a circuit block diagram in FIG. 5, a microcomputer 34 is a single chip microprocessor including a processing unit, an input/output unit, a memory, etc. and stores a program, which is explained below, for each of a cleaning mode, a mite killing mode and a display operation mode.

A cleaning/mite killing operation switching unit 35 has the mite killing switch SW1 and the shutter switch SW3.

A temperature sensing unit 36 employs a thermistor element 37 as a temperature sensing means. Supply voltage from a DC5V constant voltage unit 47 is divided by the thermistor element 37 and a resistance R25 to produce an output of sensed temperature from the thermistor element 37, and the sensed temperature output is applied to the microcomputer 34.

The thermistor element 37, although attached directly to the bracket of the electric air blower 7 for sensing a temperature of exhaust of the electric air blower 7, is electrically isolated from the electric air blower 7, so that it also can sense an unusual state in temperature when a temperature of the electric air blower 7 excessively rises. Namely, a single thermistor element 37 can sense a temperature in heating of the mite killing operation and sense an unusual rise in temperature in the electric air blower 7.

An operation level determining unit 38 is positioned in a function board on a grip portion of the suction hose connected to the cleaner body 1 and includes a suction force control rheostat VR1 for controlling a suction force of the electric air blower 7 and a brush switch SW2 for turning on and off a motor 39 driving a rotation brush of a floor nozzle. The suction force control rheostat VR1 varies the suction force of the electric air blower 7 by varying a signal voltage inputted to the microcomputer 34 depending upon a position of sliding contacts of the control rheostat. The suction force control rheostat VR1 inputs to the microcomputer 34 a signal voltage corresponding to each of a stop position (OFF level), a rug position corresponding to a "high" suction force for manual operation (H level), a floor position corresponding to an "intermediate" suction force (M level), a sofa position corresponding to a "low" suction force (L level), a curtain position corresponding to the "lowest" suction force (LL level) and an auto position for automatic control (A level). The brush switch SW2 turns on and off the motor 39 for the rotating brush when the suction force control rheostat VR1 is set at a level other than the OFF level.

A pressure sensing unit 40 uses the semiconductor pressure sensor 32 for sensing variations in pressure (negative pressure) in a space between the suction unit 7*a* of the electric air blower 7 and the suction filter 4. In this way, a sensed output voltage is produced.

Reference numeral 41 denotes an indication unit driver. The light emitting diodes D4 to D8 of the power control indicator 25 work in response to the signal voltage from the operation level determining unit 38. All the diodes put the light out when the OFF level is selected, one of them lights up at the LL level, two of them light up at the L level, three of them light up at the M level, five of them light up at the H level, and the diodes light up by the number corresponding to the sensed output voltage from the pressure sensing unit 40 when the A level is selected.

A buzzer 42 is driven by a buzzer driving unit 43. The buzzer 42 makes a sound either in the following cases where the level is changed, where the temperature sensing unit 36 senses an unusual state in temperature, where three of the light emitting diodes D1 to D3 in the dust meter 24 light up and go out, where the mite killing switch SW1 is depressed, where the mite killing operation is ended and where the thermistor element 37 is out of order due to a short-circuit or the breaking of a wire.

In a zero-cross signal generating unit 44, a bridge diode D11 shapes a waveform of an alternating voltage after voltage drop at a power source transformer T1 in a power supplying unit 45 to generate a pulse signal at a zero-cross point in each semicycle of the alternating voltage.

Reference numerals 46, 47 and 48 denote a clock oscillation unit, a 5 V constant voltage unit having a resetting unit for the microcomputer 34, and a 15 V constant voltage unit, respectively.

Reference numerals 49 and 50 denote an air blower driving unit and an air blower control bidirectional triode thyristor, respectively. They function as control means for driving the electric air blower and cooperatively drive the electric air blower 7.

Further, reference numerals 51 and 52 denote a brush motor control unit for the motor 39 driving the rotating brush of the floor nozzle, and a brush motor control bidirectional triode thyristor.

An excess current sensing unit 53 for the floor nozzle has a positive temperature characteristic thermistor 54 which restricts current to stop supplying electric power to the brush motor 39 when the motor 39 is locked because the rotation brush is tangled with a piece of cloth or the like.

The microcomputer 34 sets the operation mode at a cleaning mode when the shutter plate 15 is opened and accordingly the shutter switch SW3 is on. In the cleaning mode, the electric air blower 7 changes its suction force corresponding to the level set by the suction force control rheostat VR1 of the operation level determining unit 38, and the brush motor 39 turns on or off in accordance with ON/OFF of the brush switch SW2.

The microcomputer 34 receives an output of sensed temperature from the temperature sensing unit 36. When it is sensed that the electric air blower 7 is excessively heated and a bracket temperature is over 100° C., supplying electric power to the electric air blower is ceased to turn off all the functions.

The shutter switch SW3 turns off when the shutter plate 15 moves to close the air inlet 13. The microcomputer 34 sets the operation mode at a mite killing mode when the shutter switch SW3 is off. In the mite killing mode, as the mite killing switch SW1 is turned on, the electric air blower 7 drives and accordingly the exhaust of the electric air blower 7 circulates through the dust chamber 3. When the thermistor element 37 senses that the dust chamber 3 is heated up to 50° C. or over enough to kill the noxious small organisms such as mites, namely, a temperature of the bracket of the electric air blower 7 is 70° C. (at which the mite killing operation is stopped) or over, the microcomputer 34 as protection means functions to protect the electric air blower 7, and the electric air blower 7 is stopped.

In the mite killing mode, the first mite indicator DH1 in the mite killing indicator 26 is lit up by the green light emitting diode D9 for a predetermined period of time (e.g., 10 seconds) simultaneously with the mite killing operation starts, thereafter the first and second mite indicators DH1 and DH2 in the mite killing indicator 26 are alternately lit up with the green light emitting diode D9 and the red light emitting diode D10 for a predetermined period of time (e.g., 20 seconds). After the predetermined period of time passes, the first and second mite indicators DH1, DH2 continue to alternately light up and out until the temperature of the bracket of the air blower 7 reaches 70° C. (at which the mite killing operation is stopped). When the temperature of the bracket reached 70° C., the second mite indicator DH2 is lit up with the red light emitting diode D10. The mite killing indicator 26 indicates progress of the mite killing operation by lighting up the first mite indicators DH1, lighting up and out alternately the first and second mite indicators DH1 and DH2, and lighting up the second mite indicator DH2 with the lapse of time, so that the user can know the state of the mite killing operation from variations in an impressive visual representation. After the mite killing operation is ended, continuing lighting of the red light of the second mite indicator DH2 makes the user know that mites in the dust chamber 3 have been completely killed. For 10 minutes after the end of the mite killing operation, the buzzer also makes a continuing sound, such as "Pep, Pep", to make the user hear the end of the mite killing operation.

Also, in the case where a temperature of the bracket, which corresponds to a temperature in the dust chamber, has already reached the temperature fatal to mites, namely, 70° C. or over as just after the end of the cleaning operation in summer, the first mite indicator DH1 is lit up for the predetermined period of time (10 seconds) after the mite killing operation is started, thereafter the first and second mite indicators DH1, DH2 are alternately lit up and out for the predetermined period of time (20 seconds), and thereafter the second mite indicator DH2 is further lit up.

In case that a temperature sensed by the thermistor element 37 does not reach 70° C. within eight minutes after the mite killing operation is started when the temperature in the ambient air is low, for example, in winter, the microcomputer 34 as timer means counts a predetermined period of time (eight minutes), and after counts up to eight minutes, power supply to the electric air blower 7 is stopped to cease the mite killing operation.

Further, the microcomputer 34 sets a demonstration or self-test mode for demonstration of the vacuum cleaner by continuing to depress the mite killing button 21 for two seconds or more after the power supply plug of the cleaner is inserted into a receptacle of a commercial electric power supply while the mite killing button 21 is being depressed or by continuing to depress the mite killing button 21 for two seconds or more two seconds or shorter after the plug of the cleaner is inserted into the receptacle for electric power supply, in the conditions that the shutter switch SW3 is off, namely, in the mite killing operation mode.

In the demonstration mode, the microcomputer 34 has a function of allowing the dust meter 24, power control indicator 25 and mite killing indicator 26 to light up and light up and out with 60 lighting patterns in a single cycle. Electric power is not supplied to the electric air blower 7 in the demonstration mode, and the demonstration mode is released by pulling the plug of the cleaner out of the receptacle.

Figure 6A:
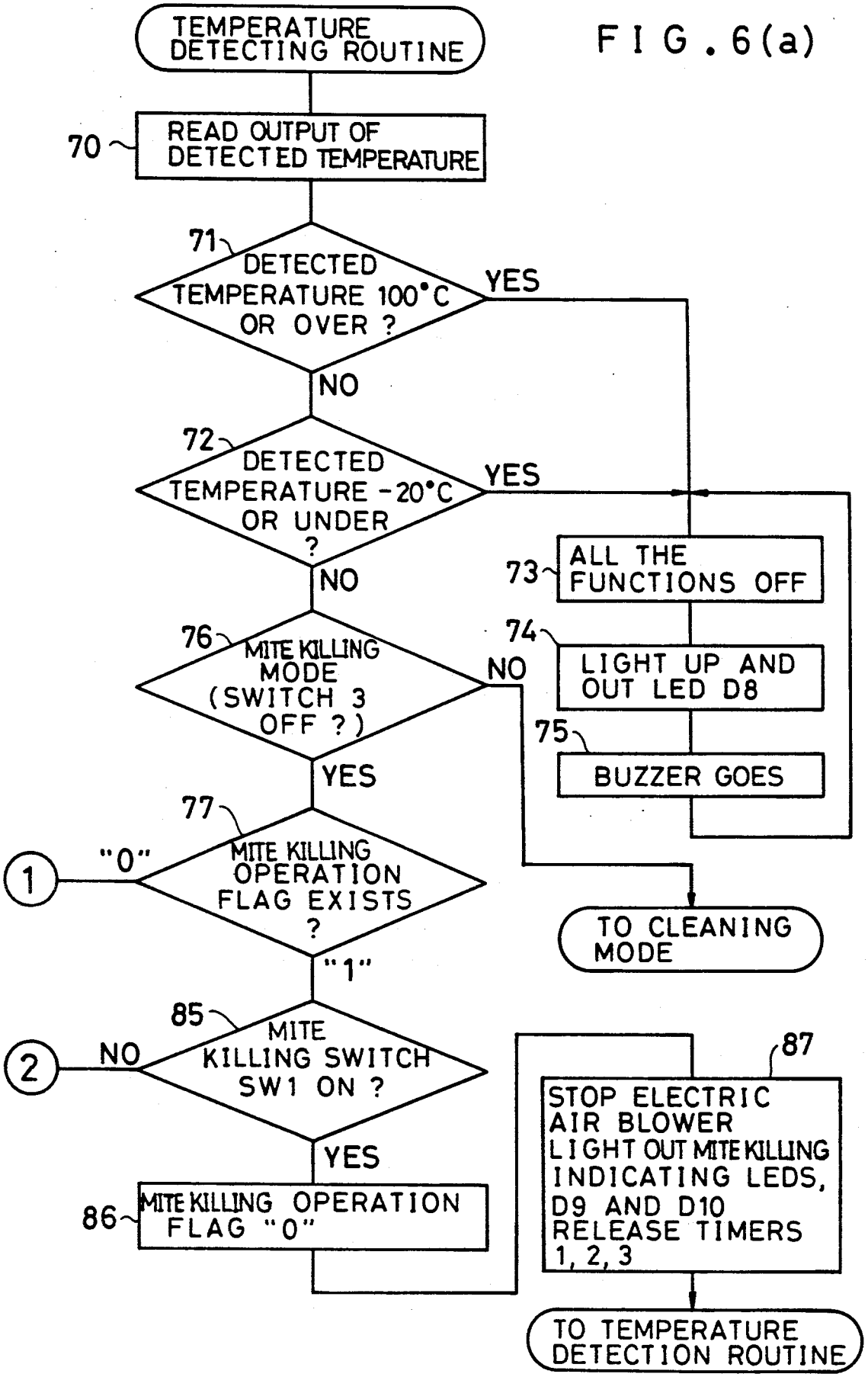
Figure 6B:
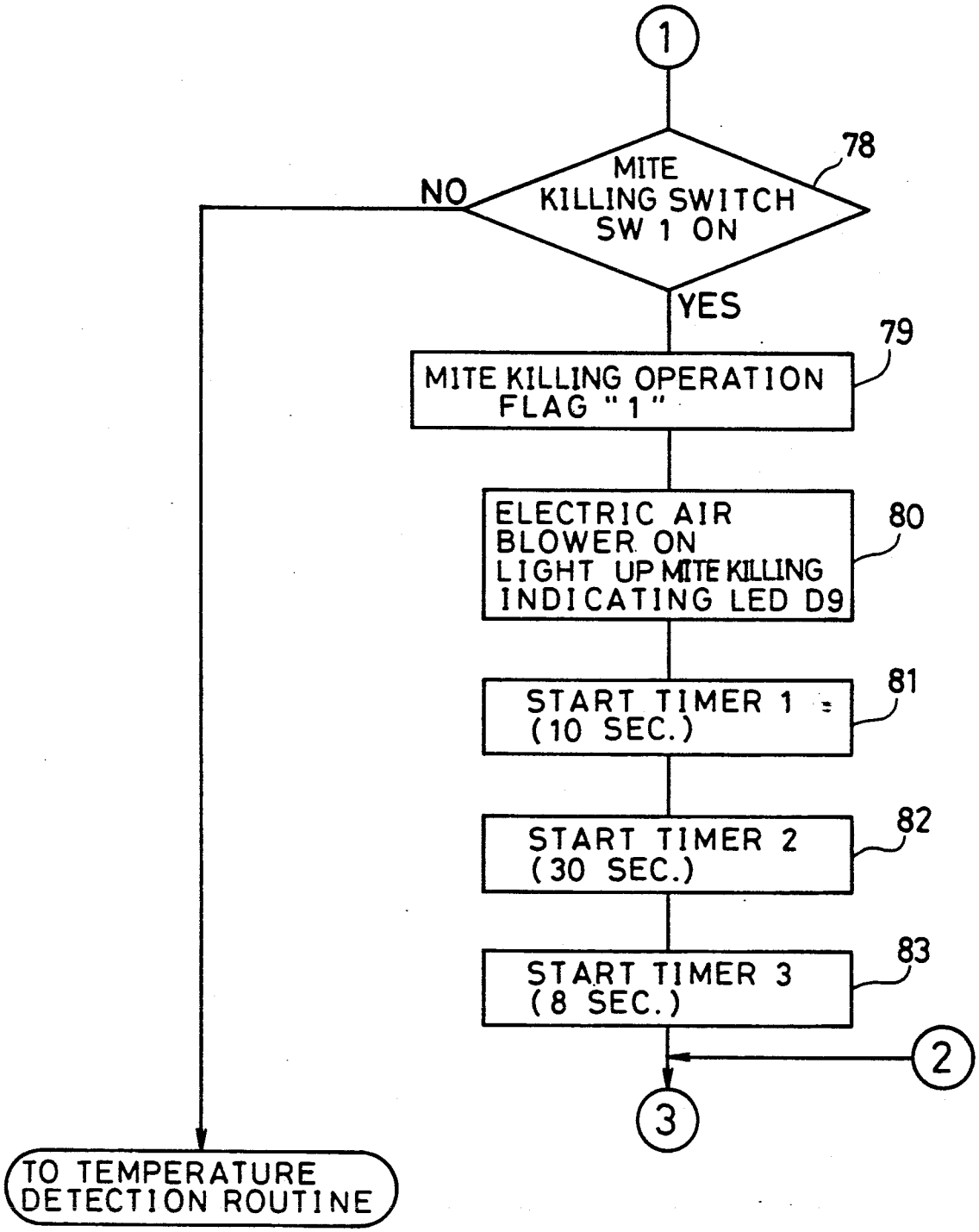
Figure 6C:
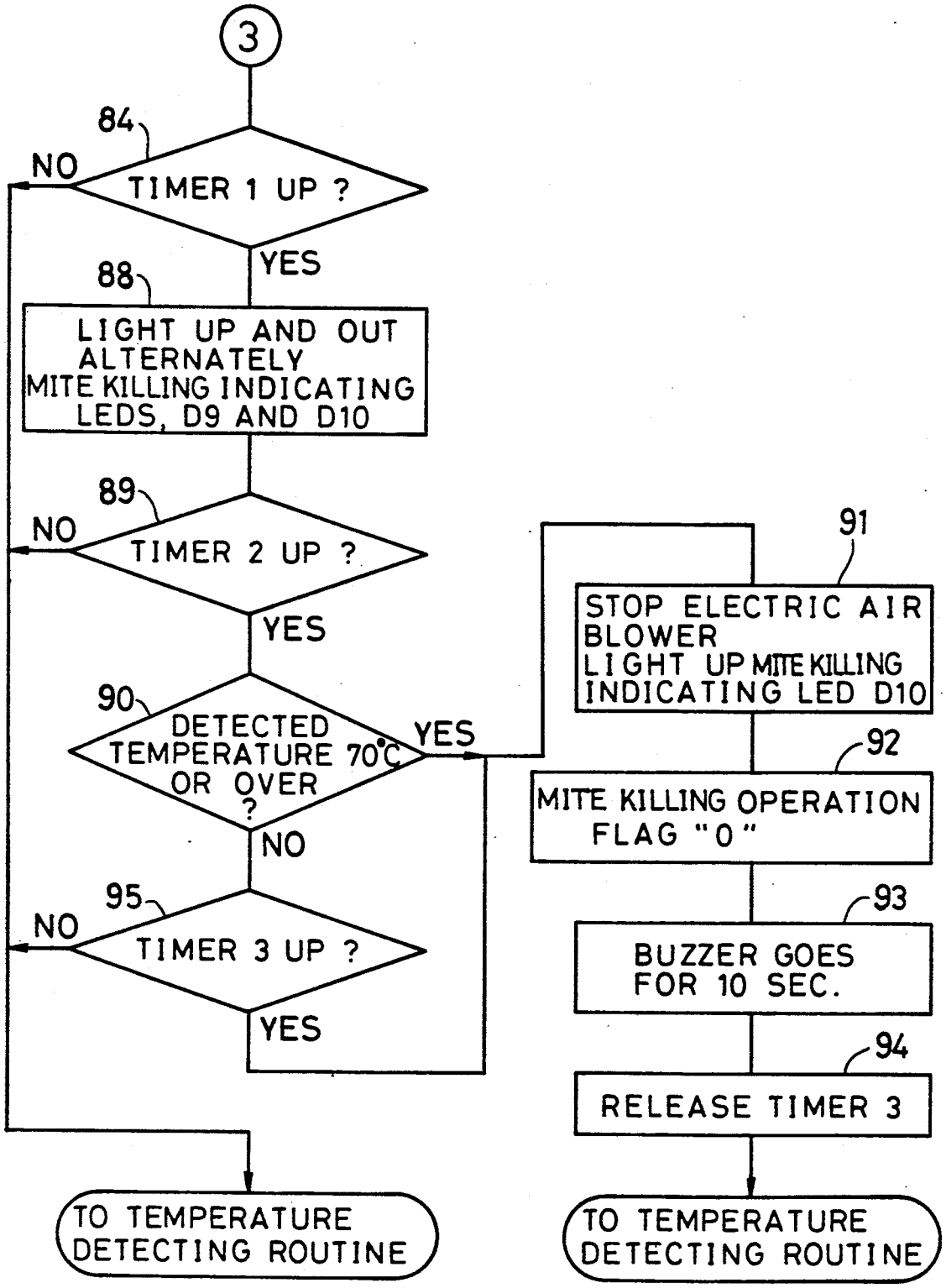

Then, the temperature sensing operation of the temperature sensing unit 36 and the mite killing operation and its display, which are all controlled by the microcomputer 34, will be explained in conjunction with flow charts shown in FIGS. 6(*a*) and 6(*c*). First, the microcomputer 34 is initialized and an operation flag (described hereinafter) is set to "0", when the plug of the vacuum cleaner is inserted into the receptacle for electric power supply.

In a temperature sensing routine, an output of a sensed temperature from the temperature sensing unit 36 is read out first (Step 70).

Then, it is judged whether or not an output data of the sensed temperature is a temperature of 100° C. or over (Step 71). If the output data is a temperature of 100° C. or under, it is further judged whether or not the output data is a temperature of −20° C. or under (Step 72). At this time, if the output data is a temperature of 100° C. or over, or −20° C. or under, it is decided that it is in an unusual state in a circuit or in temperature. Consequently, all the functions are turned off (e.g., power supply to the electric air blower 7 is stopped) (Step 73), and the light emitting diode D8 indicating an operation level lights up and out to let the user know the unusual state (Step 74) while the buzzer 42 makes a sound (Step 75), which is not stopped until the plug of the vacuum cleaner is pulled out of the receptacle for power supply source.

If the thermistor element 37 is shorted, resistance value comes to "0" and the sensed temperature corresponds to the data on sensed temperature of 100° C. or over. If the thermistor element 37 has its wire broken, its resistance value comes to infinite and the sensed temperature corresponds to the data on sensed temperature of −20° C. or user. In either of the cases, it is decided that the circuit is in an abnormal state and, consequently, all the functions are turned off similar to the above, and the light emitting diode D8 lights up and out while the buzzer 42 makes a sound, so as to let the user know that something is wrong.

When the sensed temperature is 100° C. or under, or −20° C. or over, it is judged if the operation mode is set at the mite killing mode (if the SW3 is turned off) (Step 76).

At Step 76, when the operation mode is not the mite killing mode, the processing is transferred to the cleaning mode.

If it is set at the mite killing mode, it is judged from an operation flag if the mite killing operation has been started (Step 77). If the flag is "1", the operation is going on. If the flag is "0", the operation is off. When the flag is "0", it is judged if the mite killing switch SW1 is depressed to start the mite killing operation (Step 78). If not, the processing is put back to the starting point of the temperature sensing routine.

When the mite killing switch SW1 is depressed, the operation flag is set to "1" (Step 79), the electric air blower runs and the first mite indicator DH1 is lit up by the green light emitting diode D9 (Step 80).

Then, a timer 1 for setting a lighting period (10 seconds) for the green light emitting diode D9 is started (Step 81) and, simultaneously, a timer 2 for timing temperature judgment (30 seconds) is started (Step 82). Further, a timer 3 for limiting time (eight minutes) is started to work when a temperature sensed by the temperature sensing unit 36 does not reach 70° C. in the mite killing operation (Step 83).

After the timers 1, 2, 3 are started, it is judged if the first timer 1 has ended timing the specified interval (Step 84). If not, the processing is put back to the starting point of the temperature sensing routine and carried out the above mentioned routine again.

After that, the processing similar to the above is repeated in the temperature sensing routine. However, since the operation flag is "1" at this time at Step 77, it is judged if the mite killing switch SW1 is turned on again (Step 85).

When the mite killing switch SW1 is on, the mite killing operation should be manually canceled. For that purpose, the flag is set to "0" (Step 86), the electric air blower 7 is stopped, and the green light emitting diode D9 and the red light emitting diode D10 put the light out to turn off the mite killing indicator 26 (Step 87).

When the mite killing switch SW1 is off, the mite killing operation is continued and, accordingly, it is judged again if the timer 1 has ended timing the specified interval (Step 84).

In case that the timer 1 has ended timing the specified interval at Step 84, namely, the predetermined period of time (10 seconds) has passed after the mite killing operation is started, the green light emitting diode D9 and the red light emitting diode D10 in the mite killing indicator 26 begin to alternately light up and out (Step 88) and continue it until the timer 2 ends timing the specified interval, namely, the predetermined period of time (20 seconds) further passes.

At the point of time when the timer 2 has ended timing a specified interval (Step 89), it is judged if the sensed temperature is 70° C. or over (Step 90). If the result is yes, the electric air blower 7 is stopped to end the mite killing operation, the second mite indicator DH2 is lit up by the red light emitting diode D10 (Step 91), the flag is set to "0" (Step 92), and the buzzer 42 makes a sound for 10 seconds to let the user know the end of the mite killing operation (Step 93). The timer 3 is released because it is needless (Step 94).

When the sensed temperature is lower than 70° C. at the point of time when the timer 2 has ended timing the specified interval (Step 90), the mite killing operation is continued until the sensed temperature reaches 70° C., and the green light emitting diode D9 and the red light emitting diode D10 continue to light up and out. After that, if the sensed temperature is 70° C. or over, the electric air blower 7 is stopped to end the mite killing operation similar to the above, the red light emitting diode D10 lights up, the flag is set to "0", the buzzer 42 makes a sound for 10 seconds, and the timer 3 is released. However, when the temperature around the cleaner body 1 (i.e., the temperature of the ambient air) is low, sometimes the sensed temperature may not reach 70° C. In such a case, after it is judged if the timer 3 has ended the specified timing (Step 95), namely eight minutes after the mite killing operation is started, the mite killing operation is ended.

Thus, the noxious small organisms such as mites are caught together with dust in the paper bag filter 9 of the dust chamber 3 in the cleaning operation, and they are killed with heated exhaust of the electric air blower 7 which circulating through the dust chamber 3, in the mite killing operation.

The mite killing indicator 26 represents a progress of the mite killing operation by lighting up the first mite indicator DH1, alternately lighting up and out the first and second mite indicators DH1, DH2, and lighting up the second mite indicator DH2 in this order. Thus, a state in the mite killing operation can be recognized with a visual realistic impression by variations in such visual representations, so that the user does not feel bored with cleaning until the end of the mite killing operation, and the user also does not feel the period necessary for the mite killing operation long. Additionally, the second mite indicator DH2 lights up to let the user assuredly know the extermination of the noxious small organisms such as mites, so that the user is relieved at the indication.

According to the present invention, when the temperature in the dust chamber 3 reaches a temperature at which mites should be killed, the electric air blower 7 is stopped to cease the mite killing operation. For example, when the temperature in the ambient air rises in summer enough to shorten a period of time necessary for the temperature in the dust chamber 3 to reach the temperature at which mites should perish, the mite killing operation can be ceased earlier than it would be in normal situation. Also, when a temperature of the electric air blower 7 itself extraordinarily rises, the electric air blower 7 is stopped to cease the mite killing operation. In this way, the mite killing operation can be performed in safety, and the electric air blower 7 can be protected from overheating.

Further, when a temperature of the bracket of the air blower 7, which is sensed by the thermistor clement 37, is under 70° C. (i.e., a temperature at which the mite killing operation is stopped) at least for eight minutes because the temperature in the ambient air is low, power supply to the electric air blower 7 is automatically stopped to cease the mite killing operation, so that safety in operation is assured, and the mite killing operation is never uselessly continued.

Further, the mite killing indicator 26 presents indications in the aforementioned predetermined patterns even when the temperature in the ambient air influences a temperature sensed by the sensor, so that the indications on a progress of the mite killing operation are stable independent of the temperature in the ambient air, and such stable indications assure the user.

Furthermore, a possibility that the mite killing operation is erroneously carried out twice can be eliminated, because when the mite killing operation is ended, the second mite indicator DH2 lights up to let the user assuredly know that.

When the thermistor element 37 is out of order due to the damage such as a short-circuit or the breaking of wire, all the functions (e.g., supplying electric power to the electric air blower 7) are turned off, and the light emitting diode D8 lights up and out and the buzzer 42 make a sound so as to let the user know that something is wrong. In this way, the user can assuredly know a trouble in the thermistor 37 from the light and the sound, and can perform the mite killing operation in safety.

What is claimed is:

1. A vacuum cleaner for killing noxious small organisms comprising:

a body having a dust chamber in which the organisms are trapped, an electric air blower for circulating heated exhaust air through said chamber, means for storing a predetermined temperature corresponding to a temperature fatal to noxious small organisms;

a thermistor element fixed to a bracket of said air blower for sensing the temperature of said heated exhaust air and of the surface of the electric air blower;

means for judging if the temperature sensed by said sensing means reaches said predetermined temperature and for outputting a first signal when this occurs;

means operating separately from but simultaneously with said sensing means for timing a specified interval from a point of time when said electric air blower is started and for outputting a second signal when a timed period corresponds to said specified interval; and protection means receiving and responsive to the earliest occurring of the first signal outputted from said judging means or the second signal outputted from said timer means for stopping the supply of electric power to said electric air blower to protect said electric air blower.

2. A vacuum cleaner according to claim 1, wherein said dust chamber has an air inlet, the cleaner body having a fan chamber for accommodating said electric air blower in which said fan chamber communicates with said dust chamber at the side opposite to its air inlet, said chamber having an air outlet and an air channel positioned between said electric air blower and said air outlet communicating with said dust chamber, and control means for driving said electric air blower so that heated exhaust of said electric air blower circulates along said air channel through said dust chamber.

3. A vacuum cleaner according to claim 2, further comprising a shutter plate which slidably moves across said air inlet of said dust chamber for closing said air inlet.

4. A vacuum cleaner according to claim 1, further comprising a dust-collecting filter removably attached to said dust chamber.

5. A vacuum cleaner according to claim 1, further comprising indicating means having a plurality of indicators whose indication states respectively vary in accordance with the temperature sensed by said sensing means.

6. A vacuum cleaner for killing noxious small organisms comprising:

a body having a dust chamber in which the organisms are trapped, an electric air blower for circulating heated exhaust air through said chamber, means for storing a predetermined temperature corresponding to a temperature fatal to noxious small organisms;

means for sensing a temperature related to said heated exhaust;

means for judging if the temperature sensed by said sensing means reaches said predetermined temperature and for outputting a first signal when this occurs;

means operating separately from but simultaneously with said sensing means for timing a specified interval from a point of time when said electric air blower is started and for outputting a second signal when a timed period corresponds to said specified interval;

protection means receiving and responsive to the earliest occurring of the first signal outputting from said judging means or the second signal outputted from said timer means for stopping the supply of electric power to said electric air blower to protect said electric air blower;

second means for storing an unusual temperature representing a malfunction of said sensing means, second judging means for protruding a third signal when a temperature sensed by said sensing means is said unusual temperature, and means responsive to said third signal for informing of the malfunction of said sensing means.

7. A vacuum cleaner according to claim 6, wherein said informing means is a light emitting diode and/or a buzzer.

8. A vacuum cleaner for killing noxious small organisms comprising:

a body having a dust chamber in which the organisms are trapped, an electric air blower for circulating heated exhaust air through said chamber, means for storing a predetermined temperature corresponding to a temperature fatal to noxious small organisms;

means for sensing a temperature related to said heated exhaust;

means for judging if the temperature sensed by said sensing means reaches said predetermined temperature and for outputting a first signal when this occurs;

means operating separately from but simultaneously with said sensing means for timing a specified interval from a point of time when said electric air blower is started and for outputting a second signal when a timed period corresponds to said specified interval;

protection means receiving and responsive to the earliest occurring of the first signal outputted from said judging means or the second signal outputted from said timer means for stopping the supply of electric power to said electric air blower to protect said electric air blower;

indicating means having a plurality of indicators whose indication states respectively vary in accordance with the temperature sensed by said sensing means, said indicator means comprising first and second indicators for indicating living and dead states of noxious small organisms and an indication control circuit for controlling said first and second indicators so that said first indicator lights up at the beginning of killing the noxious small organisms, said first and second indicators alternately light up and out during the killing of the noxious small organisms and both said indicators light up when the temperature in said dust chamber reaches a temperature fatal to the noxious small organisms.

* * * * *